United States Patent [19]

Kenney

[11] 4,137,144

[45] Jan. 30, 1979

[54] HOLLOW BIPOLAR ELECTROLYTIC CELL ANODE-CATHODE CONNECTING DEVICE

[75] Inventor: Edward J. Kenney, Cheektowaga, N.Y.

[73] Assignee: Hooker Chemicals & Plastics Corp., Niagara Falls, N.Y.

[21] Appl. No.: 668,390

[22] Filed: Mar. 19, 1976

[51] Int. Cl.[2] ..... C25B 9/04; C25B 11/00; C25B 11/10

[52] U.S. Cl. ..... 204/268; 204/280; 204/286; 204/290 F

[58] Field of Search ..... 204/279, 280, 286, 288, 204/283, 255, 256, 268, 290 F, 254

[56] References Cited

U.S. PATENT DOCUMENTS

| | | | |
|---|---|---|---|
| 3,788,966 | 1/1974 | Stephenson et al. | 204/256 |
| 3,849,279 | 11/1974 | Barkel | 204/286 X |
| 3,859,197 | 1/1975 | Bouy et al. | 204/286 X |
| 3,884,781 | 5/1975 | Bouy et al. | 204/279 X |
| 3,915,833 | 10/1975 | Michalek et al. | 204/279 X |
| 3,948,750 | 4/1976 | Figueras et al. | 204/290 F X |
| 3,950,239 | 4/1976 | Figueras | 204/286 X |
| 3,960,698 | 6/1976 | Bortak | 204/279 X |
| 4,017,375 | 4/1977 | Pohto | 204/268 X R |
| 4,069,130 | 1/1978 | Riggs, Jr. | 204/290 F X |

*Primary Examiner*—John H. Mack
*Assistant Examiner*—D. R. Valentine
*Attorney, Agent, or Firm*—Peter F. Casella; William G. Gosz

[57] ABSTRACT

An improved hollow bipolar electrode unit for use in an electrolytic cell is disclosed, comprising at least one connecting device within the hollow region of the electrode unit to provide mechanical support and electrical communication between the anode and cathode of such bipolar electrode.

15 Claims, 11 Drawing Figures

HOLLOW BIPOLAR ELECTROLYTIC CELL ANODE-CATHODE CONNECTING DEVICE

BACKGROUND OF THE INVENTION

This application is an improvement upon co-pending U.S. application Ser. No. 474,115, filed May 28, 1974, now U.S. Pat. No. 3,948,750, which is hereby incorporated by reference herein.

The present invention relates to a spacer device for a hollow bipolar electrode fabricated from suitable anode and cathode materials, where the spacer device provides mechanical support and reinforcement within the hollow body and provides an additional electrical current pathway from the anode to cathode. A plurality of bipolar electrodes of the present invention are arranged to form a bipolar electrolytic cell suited for use in processes which involve the electrolysis of alkali metal halides to produce useful products, including alkali metal halates, especially chlorates, alkali metal perhalates, halites and hypohalites. More particularly, sodium chlorate is specifically contemplated for production according to the teachings of the present invention, although other products of the type described are also contemplated within the scope of the present invention. Moreover, the present invention can be used to produce chlorine, hydrogen and alkali metal hydroxide in diaphragm or membrane cells from alkali metal chlorides.

In processes which produce perhalates, halates, halites, and hypohalites, reactions take place which are not electrolytic in nature. Accordingly, two regions or zones are present, namely an electrolysis zone, where most of the electrolytic reactions take place, and a reaction zone, where certain chemical reactions not electrolytic in nature take place. Electrolyte is transferred from the electrolysis zone to the reaction zone, and in some instances, electrolyte is recycled from the reaction zone back to the electrolysis zone. If chlorate is taken as an example of a product produced according to the teachings of the present reaction, the principal reactions taking place in the electrolysis zone are the following:

Anodic Reaction $$2\,Cl^- \rightarrow Cl_2 + 2\,e^-$$

$$Cl_2 + H_2O \rightleftarrows HOCl + HCl$$

Cathodic Reaction $$2H^+ + 2\,e^- \rightarrow H_2$$

The principal reactions occuring in the reaction zone are the following:

Reaction Zone Reactions $$Cl_2 + 2OH^- \rightarrow OCl^- + Cl^- + H_2O$$

$$2\,HOCl + OCl^- \rightarrow ClO_3^- + 2\,HCl$$

These reaction zone reactions can, however, also occur in the electrolysis zone in some instances.

The term "bipolar electrolytic cell" as used herein means an electrolytic cell in which at least one of the electrodes is bipolar, that is, one face or side functions as an anode and the other face or side functions as a cathode. In a bipolar electrolytic cell, each bipolar electrode is connected in series with the two electrodes that bracket or are adjacent to it. The two end or terminal electrodes are connected in series to a source of electrical current. This is in contrast to a monopolar electrolytic cell in which all of the anodes are connected in parallel and all of the cathodes are connected in parallel to a source of electrical current.

In general, bipolar electrolytic cells are advantageous over monopolar electrolytic cells because they are less complicated in design and are more economical to fabricate than are monopolar cells. For example, they are more compact and require less copper for busbar connections because there are no busbar connections between the electrodes of the individual cells. Additionally, bipolar electrolytic cells can operate at lower voltages and at higher production rates per unit floor area, thus resulting in lower operating costs and lower capital investments. These exemplify only a few of many advantages offered by bipolar electrolytic cells over monopolar electrolytic cells.

Typically a bipolar electrolytic cell contains at least one bipolar electrode which comprises an anode plate and a cathode plate, joined together and in electrical contact with each other. The anode plate and the cathode plate are fabricated from suitable anodic and cathodic materials, respectively. Suitable materials for the anode plate are the valve metals, such as titanium, with a coating of a platinum-group metal, an oxide thereof, or both, applied to the anodic surface of the valve metal. The cathode plate is usually fabricated from a metal such as steel, which is electrically conductive, resistant to corrosion by the electrolyte under cathodic conditions and resistant to reduction.

When bipolar electrodes are utilized in processes in which hydrogen is evolved at the cathode surface, they are subject to a disadvantage. During the elecyrolysis of an alkali metal halide in a bipolar electrolytic cell, for example, atomic hydrogen is formed at the steel cathode surface on the cathode side of a bipolar electrode. The hydrogen thus formed permeates through the steel cathode and attacks the titanium or other valve metal on the anode side of the bipolar electrode, forming titanium hydride, which causes blistering, embrittlement, flaking, misalignment and stress cracking of the titanium anode. The hydrogen also permeates through the titanium hydride because the initial formation of titanium hydride does not provide a barrier against further formation of titanium hydride. As the hydrogen permeates through the titanium hydride, more titanium hydride is formed and there is further deterioration of the titanium anode. This deterioration can eventually cause the titanium anode to separate from the steel cathode, and significantly decreases the useful life of the bipolar electrodes, besides contaminating the products produced by the bipolar electrolytic cells and increasing the costs of operating the cells. Although it is possible to use other cathode materials which are less permeable to hydrogen in place of steel, these materials are still permeable to hydrogen to some extent, so that steel is still the most economical and practical material to use as the cathode.

The bipolar electrode of co-pending U.S. patent application Ser. No. 474,115 overcomes the problems caused by hydrogen permeation by providing a hollow bipolar electrode structure with electrodes on either side of the hollow region in electrically conductive communication with each other. Due to the hollow nature of the electrode unit, electrical contact is effected only around the periphery of the hollow region, with no supporting means or electrically conducting pathways within the hollow space inside the bipolar electrode unit. While this hollow space is necessary in order to prevent hydrogen migration from the cathode structure to the anode structure, thereby providing a bipolar electrode which is substantially resistant to deterioration caused by hydrogen permeation, a problem of inadequate electrical conduction can nevertheless exist, in view of the relatively low specific conductivity of materials utilized in construction of the anode and the cathode, especially of the anode. Although the problem of electrical conduction can be minimized by application of a coating of highly conductive metal, such as copper, silver, alumimum or an alloy thereof, to the contacting surface at the periphery of the anode structure or the cathode structure or both, as taught in the disclosure of the invention of U.S. patent application Ser. No. 474,115, an inherent limitation in the current distribution capacity nevertheless exists by virtue of the necessity for current to pass between the face of an electrode and the periphery of an electrode, giving rise to resistive heating and energy loss. Furthermore, no mechanical support is provided within the hollow space between anode and cathode, giving rise to the possibility of loss of dimensional control over the inter-electrode gap between adjacent bipolar units, a spacing which can be critical to the efficient operation of an electrolytic cell.

DESCRIPTION OF THE PRIOR ART

Described in the application of Ser. No. 474,115 are several U.S. patents disclosing bipolar electrolytic cells or bipolar electrode configurations, including the following U.S. patents: 3,778,362, issued Dec. 11, 1973; 3,759,813, issued Dec. 18, 1973; 3,219,563, issued Nov. 23, 1965; 3,402,117, issued Sept. 17, 1968; 3,441,495, issued Apr. 29, 1969; and 3,451,914, issued June 24, 1969.

Particular attention is directed to U.S. Pat. No. 3,451,914, issued June 24, 1969 to Colman. Although FIG. 5 of Colman depicts connecting devices between two plates which bear a superficial resemblance to a device of the present invention, the Colman device performs an entirely different function from that of the present invention. No hollow space between the anode and cathode exists in Colman. In Colman, there exists a reaction volume between the two parallel electrode plates supported by cylindrical titanium rods. Colman is accordingly directed toward solving the problem of improving circulation of electrolyte in a bipolar cell, while the present invention is directed towards solving the problem of hydrogen permeation into a valve metal anode.

The bipolar electrode unit of Colman teaches a plate of cathodic material, such as iron, bonded to a plate of anodic material, such as titanium, with the remaining structure serving as an extension of the anodic surface, in order to promote circulation of electrolyte and provide a reaction zone with higher reaction efficiency. In the present invention, a reaction zone outside the electrolytic cell is contemplated, and the connecting devices link a cathode and anode, rather than an anode and an extension of the anode.

Another patent comprising the prior art from which the present invention departs in U.S. Pat. No. 3,759,813 to Raetzsch et al. Raetzsch et al disclose a bipolar electrolytic cell wherein a plurality of non-foraminous anodes are inserted within a plurality of enveloping foraminous cathodes of complex design. Raetszch et al teach prevention of hydrogen migration into the anode by means of a protective sheet, separated from a steel cathode back plate by a space which may contain electrolyte or may be electrolyte-free. Although a protective metal sheet may be joined to the back plate by means of a plurality of studs of highly complex design, these studs do not directly separate a titanium from a steel surface, as does the present invention. Furthermore, Raetszch et al require the studs to be plug welded to one surface separated from the other surface by the space or gap which serves to prevent hydrogen migration. When this gap is as large as is illustrated in the present invention, a welding technique such as is taught by Raetzsch et al is not suitable. The present invention, on the other hand teaches a novel method which is suitable for joinder of electrode plates separated by a gap, such method being applicable to electrode plates which include titanium as one of the members. Problems of plug welding titanium which would necessarily result from an application of the Raetszch et al technique to solution of the present problem are thereby avoided.

U.S. Pat. No. 3,441,495 to Colman relates to bipolar electrolytic cells with an anode and cathode of each composite bipolar electrode comprising a material which can permit the electrolyte to boil. No provision is made in Colman for a hollow space, for a method for preventing hydrogen permeation into the anode material, or for any type of spacer means between bipolar unit electrodes.

Hollow bipolar electrodes suitable for use in bipolar electrolytic diaphragm cells are disclosed in U.S. Pat. No. 3,778,362, issued Dec. 11, 1973 to Wiechers et al. Wiechers et al disclose a typical bipolar electrode comprising a hollow steel spacer body inserted into a filter presstype frame which is a non-conductor of electricity and is resistant to corrosion by electolyte. Although a hollow region is defined by the cell frame, this region is filled with electrolyte, and Wiechers et al teach no method for solving the problem of hydrogen permeation into the anode. The present invention overcomes difficulties associated with leakage, cracking, and corrosion resulting from the need to apply longitudinal compressive force to maintain sealing and structural rigidity. One object of the present invention is to provide structural support between anode and cathode surfaces by means of the connecting devices of the present invention.

Bipolar electrodes and bipolar electrolytic cells are also disclosed in U.S. Pat. No. 3,219,563, issued Nov. 23, 1975; in U.S. Pat. No. 3,402,117, issued Sept. 17, 1968; and U.S. Pat. No. 3,441,495, issued Apr. 29, 1969, which patents are cited herein to illustrate the state of the art.

SUMMARY OF THE INVENTION

The invention relates to an integral anode-cathode unit comprising an anode structure and a cathode structure in electrically conductive communication through one or more anode-cathode connecting devices. At least one of the anode or cathode structures is concave in configuration or shape with respect to its inner surface so that a hollow space is formed within the bipolar electrode. The hollow electrode is provided with at least one gas vent to permit escape of gases which may collect in the hollow space of electrode during electrolysis. Both the anode structure and the cathode structure can be concave or one structure can be concave and the other structure can be convex with respect to the inner surfaces, to form a hollow space within the bipolar electrode. Connecting units which provide electrical communication and mechanical support for the integral anode-cathode unit comprise an anode portion attached and projecting from an anode structure, and a cathode portion, attached to and projecting from the cathode structure. When assembled to form the hollow region within the anode-cathode unit, the anode and cathode portions of the connecting devices form a mechanical contact which provies mechanical support and electrical communication through the gap inside the hollow space of the integral bipolar electrode unit.

The anode structure is preferably fabricated from a non-foraminous valve metal base which has an electrically conductive coating applied to its active anodic or unoxidized surface, said coating being resistant to corrosion by the electrolyte under anodic conditions and resistant to oxidation. Suitable valve metals include titanium, niobium and zirconium, preferably titanium. The anode coating preferably contains one or more platinum-group metals, platinum-group metal oxides, or both. Suitable platinum-group metals include platinum, ruthenium, rhodium, palladium, osmium and iridium. Any of several methods can be used to apply the coating to the valve metal base, such as precipitation of the metals or metallic oxides by chemical, thermal or electrolytic processes, ion plating, vapor deposition or other suitable means.

The cathode structure is preferably fabricated from steel, but chromium, cobalt, copper, iron, lead, molybdenum, nickel, tin, tungsten or alloys thereof can also be used. The cathode, like the anode, is formed from a non-foraminous sheet or plate of metal.

In one embodiment of the present invention the anode-cathode connecting device comprises a titanium threaded sleeve welded to the metal anode, positioned over a hole in the cathode so as to permit a titanium bolt to pass through the cathode hole, be bolted to the sleeve and to form a mechanical and electrical connection. an elastomeric washer or other sealing means prevents passage of the elctrolyte into the hollow space separating the anode and cathode. In order to render the bolt head non-conductive a plastic film can be applied to the bolt head before or after assembly. Alternatively, the bolt can be inserted into a countersunk recess within the cathode with use of a tapered elastomeric sealing means instead of a washer. It is preferred to avoid use of a conductive bolt head which projects into the electrolyte, since high current densities in the electrolyte surrounding such bolt heads could easily lead to local heating, interfering with proper electrolysis conditions.

In another embodiment, a titanium-clad highly conductive metal rod is welded to the anode, threaded, and a chemically resistant bolt is passed through a cathode hole, which may or may not be countersunk and bolted to the sleeve to form a mechanical and electrical connection. Means can be provided for preventing deleterious effects of local electrolyte heating in the vicinity of projecting bolt heads, either by application of an insulating film or by use of countersunk bolt heads, as described in the first embodiment above.

In yet another embodiment of the present invention, a metal stud comprising a highly conductive metal, such as copper, clad with a valve metal, such as titanium, is welded about the base to the anode. A cathode with a hole properly positioned is placed with the hole located over the conductive metal portion at the opposite end of the stud, and a weld through the hole secures the cathode to the stud. A fillet can be inserted into the space remaining and ground flush. In all embodiments, a plurality of anode-cathode connecting devices can be utilized, and these can be arranged as an evenly spaced array to promote maximum structural support and uniform current conduction.

Electrical conductivity between the anode structure and the cathode structure can be improved even further than that resulting from conduction through the anode-cathode connecting devices by applying a coating of a highly conductive metal, such as copper, silver, aluminum or an alloy thereof, to the peripheral contacting surface of the anode structure or the cathode structure or both. Any of several methods can be used for applying the highly conductive metal coating to either the anode structure or the cathode structure, such as precipitation of the metals by chemical, thermal or electrolytic means. The electrical conductivity between the anode structure and the cathode structure can also be improved by inserting strips of a highly conductive metal, such as copper, silver, aluminum or an alloy thereof, between the anode structure and the cathode structure.

A typical bipolar electrolytic cell can be assembled by arranging in a row one or more of the hollow bipolar electrodes containing the connecting devices of the present invention. Each bipolar electrode unit is positioned parallel to but spaced apart from the adjacent electrode units. Suitable spacer frames are made of a material which does not conduct electricity, are resistant to corrosion by the electrolyte, can withstand the operating temperatures of the bipolar electrolytic cell, and can be used to separate each hollow bipolar electrode and the two terminal electrodes positioned at each end of the row of one or more hollow bipolar electrodes. Exemplary of materials suitable for fabricating spacer frames are various thermoplastic or thermosetting resins, such as polypropylene, polybutylene, polytetrafluoroethylene, rigid FEP, chlorendic acid based polyesters, and the like.

The spacer frames are provided with suitable entrance and exit ports to allow for circulation of the electrolyte through the bipolar electrolytic cell. Generally, the electrolyte will enter at the bottom of the cell and exit from the top of the cell, although other positions for such ports may also be used. Normally, the electrolyte passes through only one bipolar electrolytic cell unit. Suitable piping arrangements can be made, however, to enable the electrolyte to be circulated through more than one bipolar electrolytic cell unit.

A suitable gasket or sealant material, such as Neoprene or other chloroprene rubbers, Teflon, or other fluorocarbon resins, or the like, can be placed between each electrode and frame to provide a gas and liquid tight seal. The individual electrodes and spacer frames comprising the bipolar electrolytic cell can be joined and held together by any suitable means, such as bolting, clamping, riveting or the like. A particularly preferred means of joining and holding the electrodes and spacer frames together is a filter press type arrangement wherein pressure means are applied to the end electrodes or suitable end pressure plates, to hold the entire cell assembly together as an operable unit.

DETAILED DESCRIPTION OF THE DRAWINGS

Figure 1:
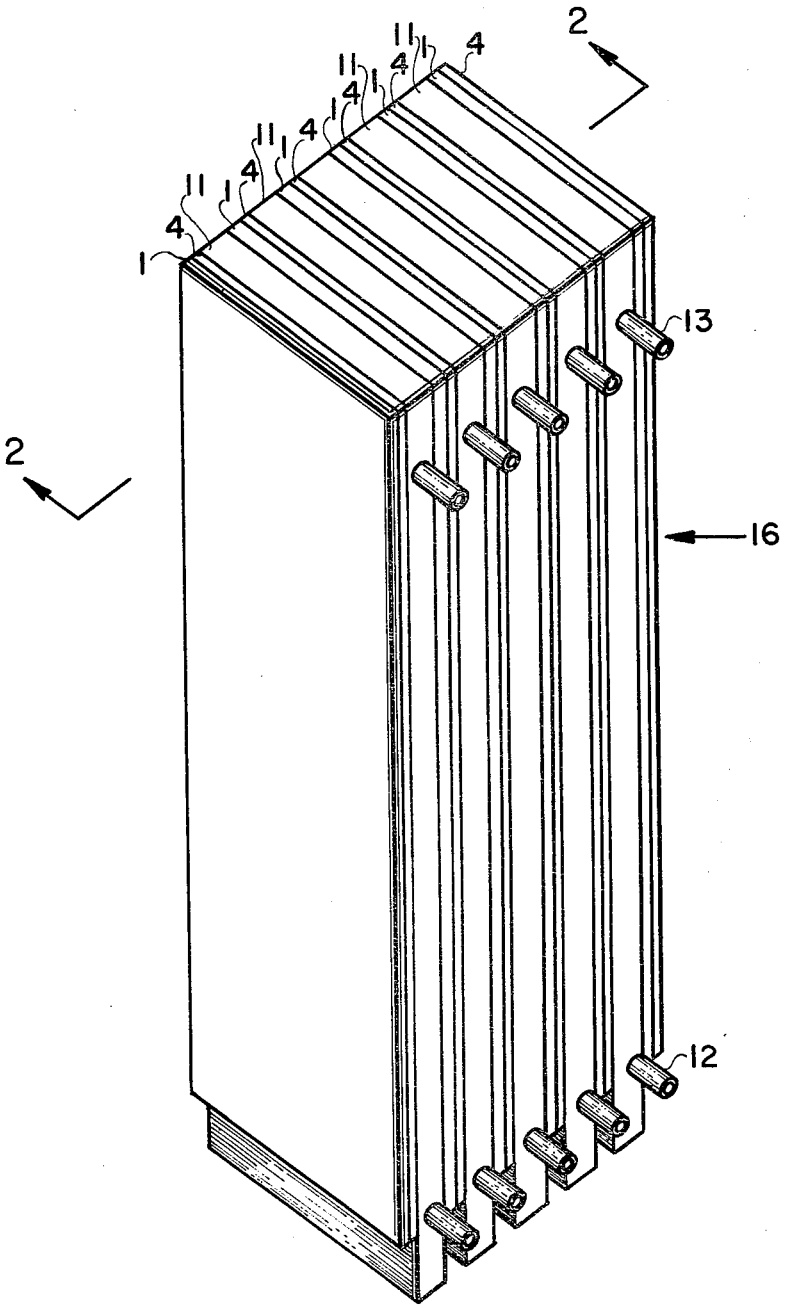
FIG. 1 is a perspective view of a typical assembled bipolar electrolytic cell.
Figure 2:
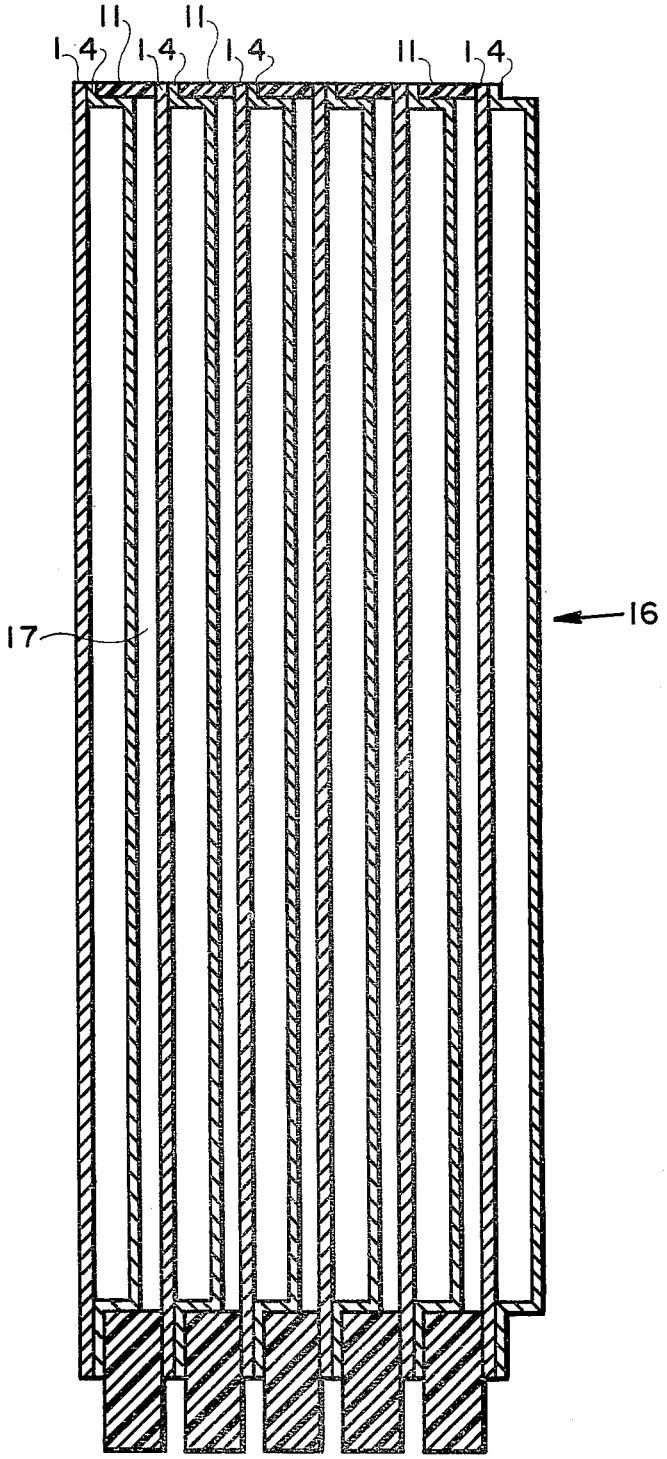
FIG. 2 is a sectional view of the cell of FIG. 1.
Figure 4:
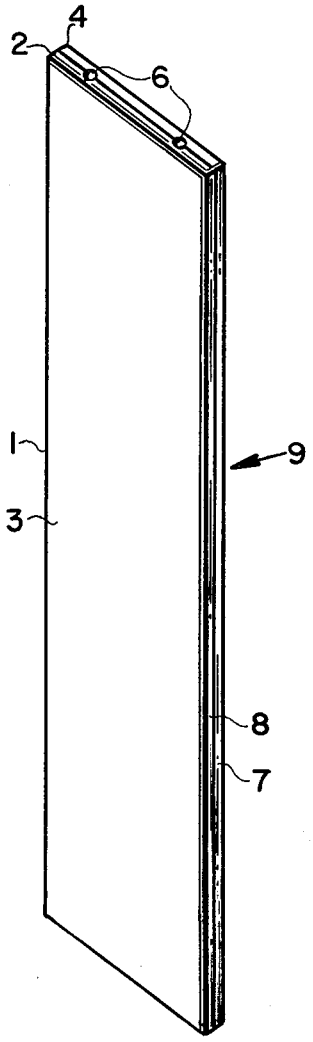
FIG. 4 is a perspective view of a typical assembled bipolar electrode.
Figure 5:
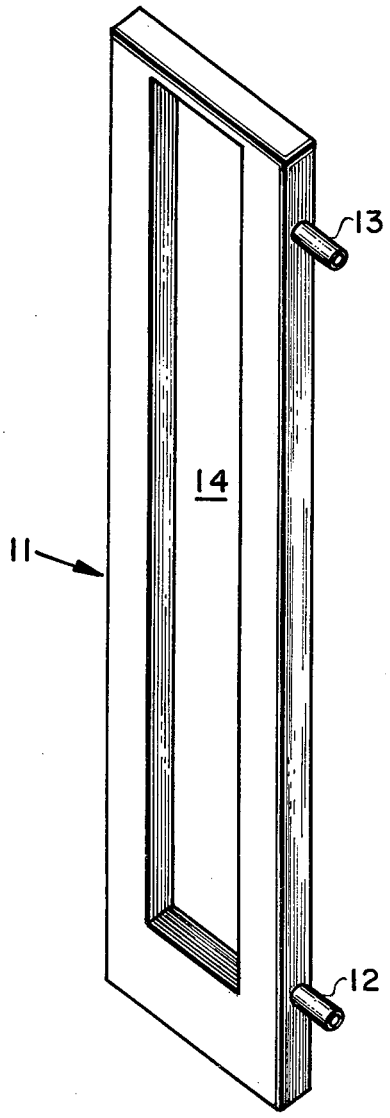
FIG. 5 is a perspective view of a typical spacer frame.
Figure 10:
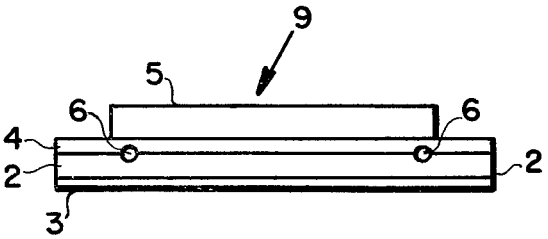
FIG. 10 is a top view of the electrode of FIG. 4.

FIGS. 1, 2 and 10 are perspective and top views of a bipolar electrolytic cell 16 and a bipolar electrode unit 9, formed from the bipolar electrode member and cell frame member shown generally in FIGS. 4 and 5. The bipolar cell assembly 16 is in the form of a filter press configuration comprising a plurality of a bipolar electrode units 9 separated by cell spacer elements 11. Suitable gasketing material can be provided between the various electrode and cell frame members as is necessary to provide a liquid and gas tight seal. The filter press assembly can be held together in any convenient manner, such as by means of bolts or tie rods or the like (not shown) or by means of a filter press frame whereby the electrode and cell spacer members are forced together under sufficient compressive pressure to prevent leakage, in a manner which is well-known in the art.

An electrolysis zone 17 is formed between the cathode 4 of one electrode member 9 and the anode 1 of the adjacent electrode member. Typically the width of this electrolysis zone can range from about ¼ inch to about 1/64 inch, although the exact value can vary with the size of the cell, the current load, and the type of electrolyte undergoing processing. Electrolyte inlets 12 and electrolyte outlets 13 are provided in the electrolysis zone 17, which electrolyte inlets and outlets are formed in that portion of side walls of the cell frame 11 which extends beyond the concave portion 5 of the cathode 4. Although only one such inlet and outlet has been shown for each electrode unit, additional inlets or outlets can be provided if desired. Additionally, as is shown in FIGS. 4 and 10, gas vents 6, which communicate with the hollow interior of the electrode unit 9, are also provided to allow the release of gases, particularly hydrogen, which permeates steel cathode 4 during electrolysis. In this way, the attack by hydrogen on the titanium anode is greatly minimized, if not substantially prevented.

FIGS. 4 and 10 show bipolar electrode 9 formed from anode 1 and cathode 4, anode 1 comprising sheet portion 2 and electrically active coating 3. In the assembled electrode, as is shown most clearly in FIG. 10, the concave portion 5 of the cathode 4 is located on the side of the electrode opposite the electrically active coating 3 on sheet portion 2 of the anode 1. When assembled in this manner, a hollow bipolar electrode structure is formed in which the anodic reaction occurs at the noble metal or noble metal oxide coating 3 on the anode and the cathodic reaction occurs on the opposite side of the electrode on the surface of the concave portion 5 of the cathode. Perimeter surface 7 of cathode 4 and perimeter surface 8 of anode 1 can be provided with a coating of highly conductive metal, such as copper, silver, aluminum, or the like, to improve electrical conductivity between anode 1 and cathode 4.

FIG. 5 shows a perspective view of a cell frame 11 which is utilized in an assembled bipolar cell to separate the bipolar electrode units described above. The cell frame is provided with the central cut-out portion 14, the size and shape of which is such as to accommodate the concave portion 5 of the cathode 4. Preferably the spacer frame is fabricated from polypropylene, although other suitable materials which are electrically non-conductive and resistant to corrosion by the environment in which the spacer frame is used and which would withstand the operating temperatures of the cell, can also be utilized. The thickness of the spacer frame 11 is such that it is greater than the depth of the concave portion 5 of the cathode member 4 which is inserted into the cut-out portion 14 of the frame. Additionally, the electrolyte inlet port 12 and electrolyte outlet port 13 are formed in that portion of the side edge of the frame which extends beyond the concave portion 5 of the cathode. In this manner, when the electrode members and the spacer frames are assembled into the bipolar cell, this extended portion of the frame maintains a space between the concave portion of one cathode member and the anode member of the next adjacent member, thus forming the electrolysis zone.

Figure 3:
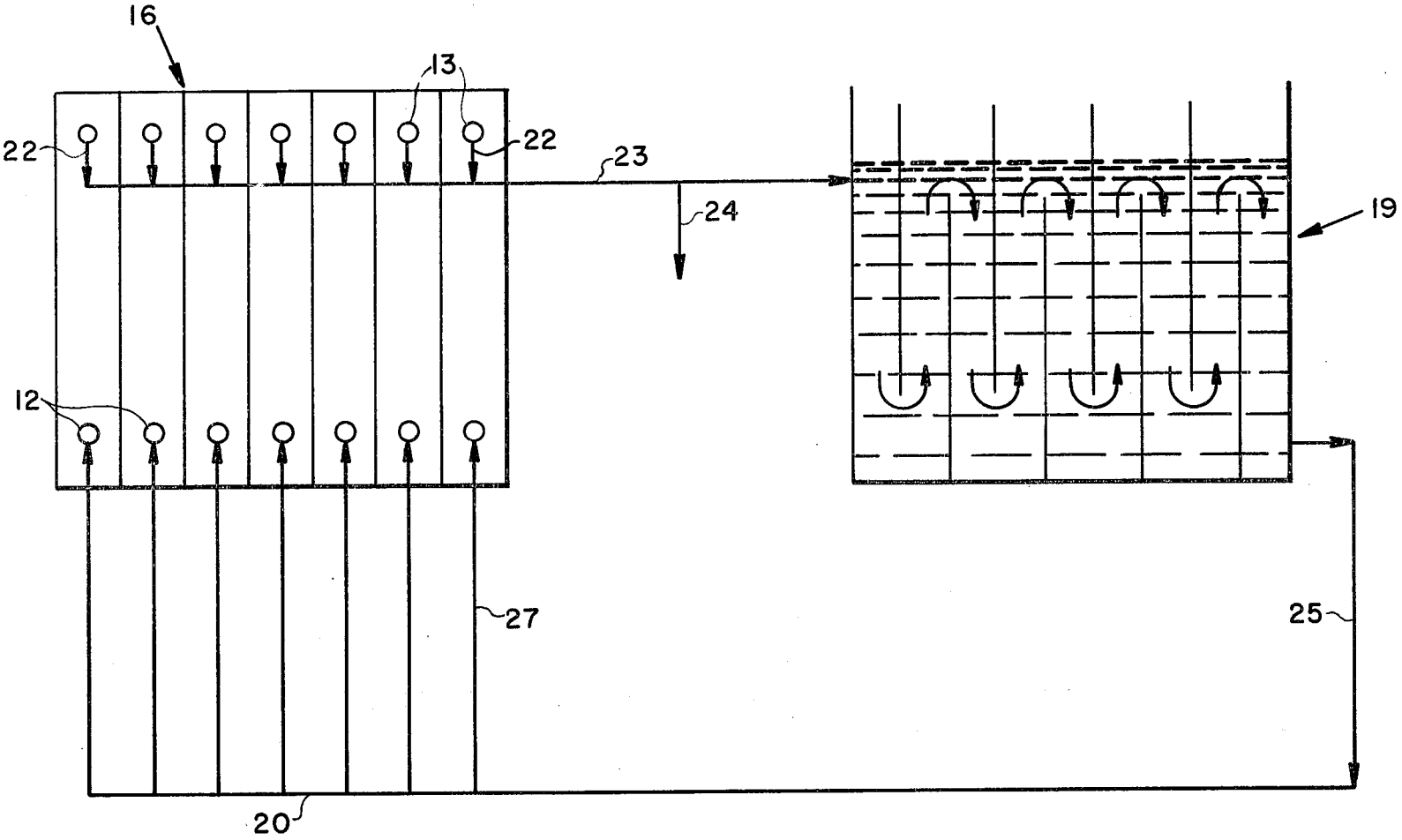
FIG. 3 is a schematic representation of the bipolar electrolytic cell in conjunction with a reaction tank.

FIG. 3 is a schematic representation of a preferred method of continuously operating cells of the present invention to produce sodium chlorate. Electrolyte is continuously introduced through inlet lines 27 into the inlet ports 12 of the bipolar electrolytic cell 16. The electrolyte is removed from the cell through outlet ports 13 passing through lines 22 and 23 to reaction tank 19. The electrolyte solution, containing hypochlorous acid and sodium hypochlorite, passes through the baffled sections of the reaction tank, wherein the formation of sodium chlorate is completed. The chlorate containing solution is then removed from reaction tank 19 through line 25 and is reintroduced into the cell 16 through line 20 and lines 27. This process is continued until the desired concentration of chlorate in the electrolyte is achieved, at which point a portion of the sodium chlorate containing electrolyte is removed through line 24 as the product of the process. Fresh feed can be introduced into tank 19 as needed.

Figure 6:
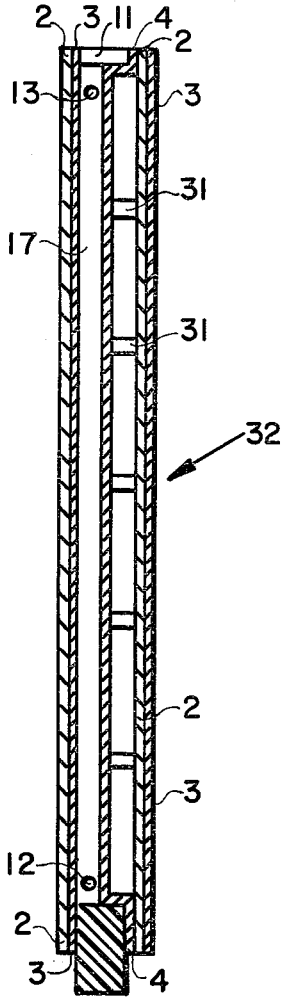
FIG. 6 is a cross section of a side elevation view of a typical single bipolar electrolytic cell unit.
Figure 11:
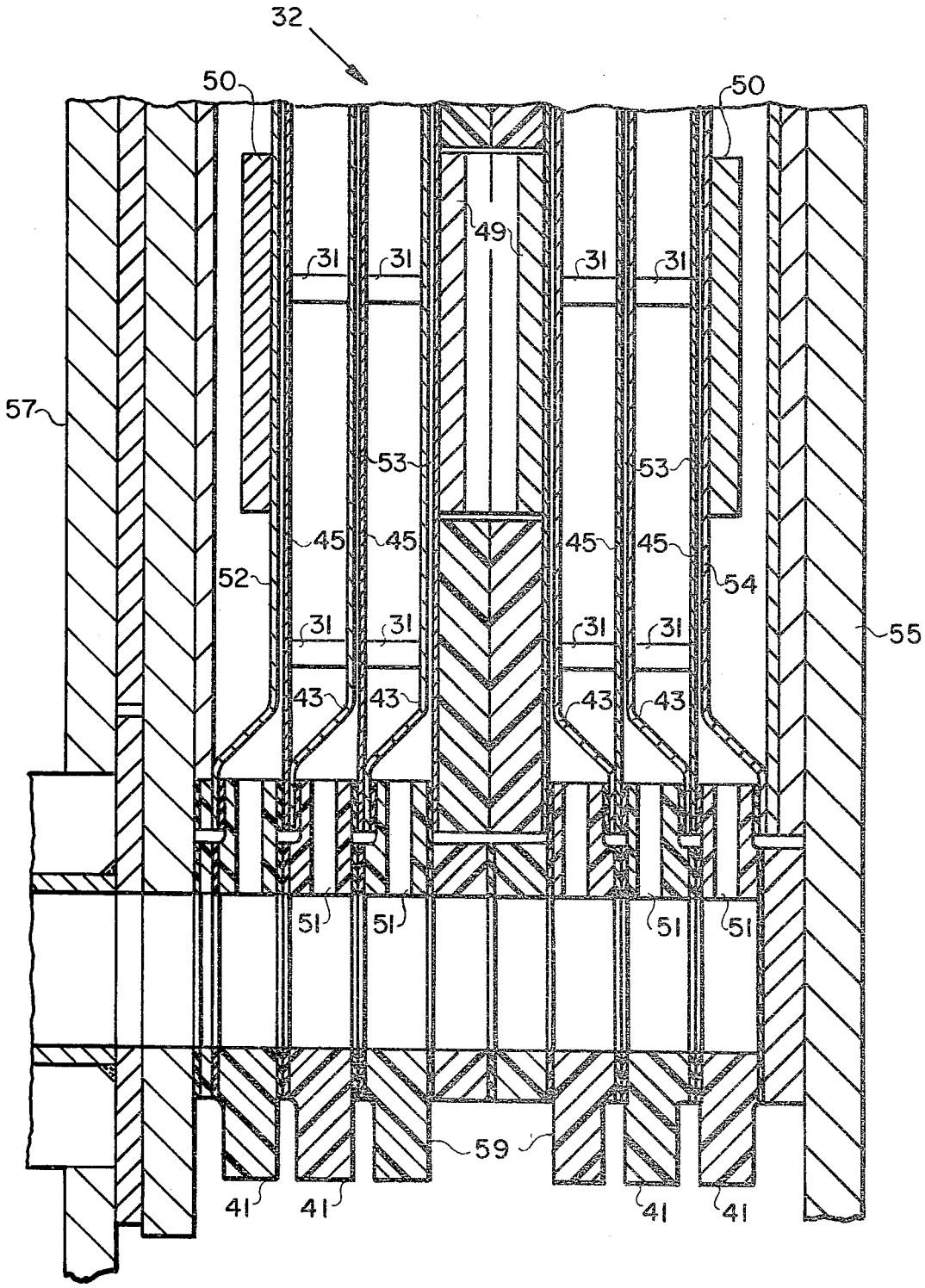
FIG. 11 is a sectional view of a plurality of bipolar electrode units arranged to form a cell.

FIGS. 6 and 11 are cross sections of a side elevation view of a typical single bipolar electrolytic cell unit where the connecting devices 31 of electrode unit 32 are represented schematically between cathode 4 and sheet portion 2 of the anode, comprising the sheet portion 2 and electrically active coating 3 of the anode. In another embodiment of the bipolar electrolytic cell unit, shown in FIG. 11 with a plurality of electrode units 41 comprising hollow cathodes 43, planar anodes 45, and connecting devices 31, are arranged to show the center of a cell stack including busbars 49 from which current is distributed into the cell, and busbars 50 which are located at terminal cathodes 52 and 54, completing the cell electrical circuit. Inlet ports 51 allow entrance of electrolyte within the electrolysis regions 53. A movable metal end plate 55 is shown, as well as a fixed end plate 57. Although only six bipolar electrolytic cell units are shown in FIG. 11, a greater or lesser number can be assembled to form the cell. Cell frame members 59 separate individual anode 45 and cathode units 43, and have a thickness to provide the optimum gap within the electrolysis regions 53.

Figure 7:
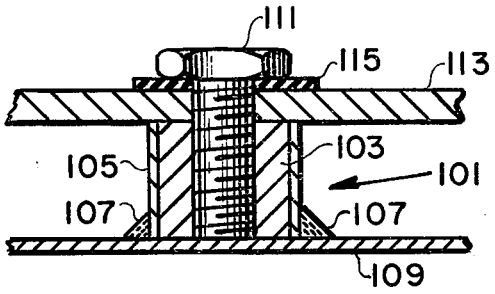
FIG. 7 is an enlarged sectional view of the region surrounding a typical bipolar connecting device of FIG. 6 in its first embodiments.
Figure 8:
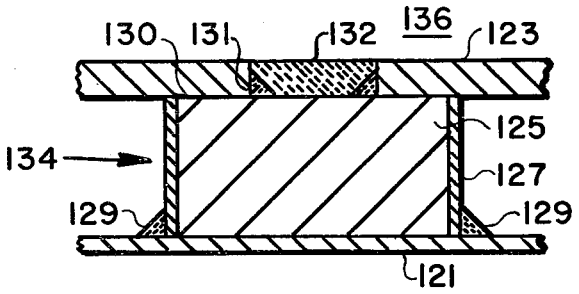
FIG. 8 is a sectional view of another embodiment of a connecting device of the present invention.
Figure 9:
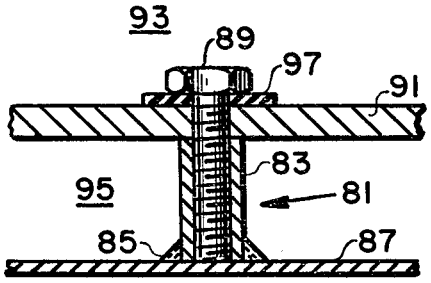
FIG. 9 is an enlarged sectional view of yet another embodiment of a connecting device of the present invention.

FIGS. 7, 8, and 9 show embodiments of connecting devices designated 31 in FIG. 6 and designated 47 in FIG. 11.

In FIG. 7, connecting device 101 comprises a sleeve with an inner core 103 of highly conductive metal, such as copper, with surface cladding 105 of valve metal, such as titanium. The sleeve is welded at 107 to anode 109, and bolt 111, preferably made of a chemically resistant material such as titanium, cathodically protected steel, a chemically resistant plastic, such as polyvinylidine fluoride or chlorinated polyvinyl chloride, holds cathode 113 and is in electrical communication with cathode 113. Sealing means 115 is a gasket or washer which is preferably made of an elastomeric material which prevents the flow of liquid through the opening of cathode 113.

Another embodiment of the connecting device is shown in FIG. 8, where a metal stud connects anode 121 and cathode 123. The interior portion 125 of said stud comprises a highly conductive metal, such as copper or silver, and the exterior 127 is clad with a valve metal, such as titanium. Weld 129 secures the metal stud to anode 121, and weld 131 is then made to secure cathode 123 to the stud opposite end 130 to form an integral anode-cathode unit 134, which is able to conduct electricity from one face to the opposite face. The region between weld 131 and the electrolyte 136 is subsequently filled by inserting a steel fillet 132, which is welded to cathode 123 and ground flush.

FIG. 9 shows connecting device 81 comprising threaded cylindrical sleeve 83 welded at 85 to anode 87. Chemically resistant bolt 89, made of a material such as titanium, cathodically protected steel, or a chemically resistant plastic, such as polyvinylidine fluoride or chlorinated polyvinyl chloride, passes through cathode 91 and is threaded into sleeve 83. Leakage of fluid between the electrolytic region 93 and hollow region 95 is prevented by washer or gasket sealing means 97.

While this invention has been described with respect to certain embodiments, they are not intended to limit the scope of the invention, but rather to illustrate the invention, and various changes in the form and design are contemplated within the scope of the invention.

In the specification and claims, parts and proportions are expressed by weight and temperatures in degrees Celsius unless specified otherwise.

We claim:

1. In a hollow bipolar electrode, comprising an anode member and a cathode member, each of which is formed of non-foraminous metal, at least one of said members having a concave portion which, when said members are joined together in electrically conductuve contact along the periphery thereof, forms a hollow section in the interior of said bipolar electrode, the improvement comprising at least one electrically conductive connecting device between said anode member and said cathode member, within the hollow section, said connecting device providing dimensional control of the inter-electrode gap between adjacent bipolar units.

2. The electrode of claim 1 wherein a plurality of said connecting devices is disposed in a regularly spaced array.

3. The electrode of claim 2 wherein the anode member is formed of a valve metal and has an electrically conductive, anodically resistive coating on at least a portion of its exterior surface.

4. The electrode of claim 3 wherein the valve metal is selected from the group consisting of titanium, tantalum and niobium and the electrically conductive coating contains at least one material selected from the group consisting of platinum group metals and platinum group metal oxides.

5. The electrode of claim 4 wherein the cathode member is formed of a metal selected from the group consisting of iron, steel, chromium, cobalt, copper, lead, molybdenum, nickel, tungsten and alloys thereof.

6. The electrode of claim 5 wherein the cathode member is steel.

7. The electrode of claim 5 wherein the connecting device comprises a cylindrical titanium sleeve threaded on the inside and welded to the anode member, and an elastomeric sealing ring in alignment with a hole through said cathode member, through both of which passes a chemically resistant bolt threaded into the inside of said titanium sleeve.

8. The electrode of claim 5 wherein the connecting device comprises a titanium-clad highly conductive metal sleeve is threaded on the inside and welded to said anode member, and a sealing ring is aligned with a hole passing through said cathode member, through both of which pass a chemically resistant bolt in threaded mechanical and electrical engagement with said sleeve.

9. The electrode of claim 5 wherein said connecting device comprises a titanium-clad copper rod, welded about the periphery of said rod to said anode member, and welded between the copper portion of said titanium clad rod and said cathode member to form an integral anode-cathode unit.

10. The electrode of claim 8 wherein said chemically resistant bolt is made of titanium.

11. The electrode of claim 8 wherein said chemically resistant bolt is made of cathodically protected steel.

12. The electrode of claim 8 wherein said chemically resistant bolt is made of a chemically resistant plastic.

13. The electrode of claim 7 wherein said chemically resistant bolt is made of titanium.

14. The electrode of claim 7 wherein said chemically resistant bolt is made of cathodically protected steel.

15. The electrode of claim 7 wherein said chemically resistant bolt is made of chemically resistant plastic.

* * * * *